US005452990A

United States Patent [19]

Niebler et al.

[11] Patent Number: 5,452,990

[45] Date of Patent: Sep. 26, 1995

[54] FOOT ARRANGEMENT FOR A LIQUID RING MACHINE

[75] Inventors: Hermann Niebler, Rednitzhembach; Hans Weigl, Velburg, both of Germany

[73] Assignee: Siemens Aktiengesellschaft, Munchen, Germany

[21] Appl. No.: 371,675

[22] Filed: Jan. 12, 1995

Related U.S. Application Data

[63] Continuation of Ser. No. 157,593, Nov. 24, 1993, abandoned.

[30] Foreign Application Priority Data

Nov. 24, 1992 [DE] Germany ..... 42 39 462.7

[51] Int. Cl.[6] ..... F04C 19/00

[52] U.S. Cl. ..... 417/68

[58] Field of Search ..... 417/68, 69, 236, 417/238

[56] References Cited

U.S. PATENT DOCUMENTS

| | | | |
|---|---|---|---|
| 2,098,244 | 11/1937 | Hopfensberger | 417/68 |
| 2,453,373 | 11/1948 | Kollsman | 417/68 |
| 3,303,991 | 2/1967 | Dardelet | 417/68 |

FOREIGN PATENT DOCUMENTS

| | | | |
|---|---|---|---|
| 880382 | 10/1952 | Germany . | |
| 177867 | 3/1954 | Germany | 417/68 |
| 2605423 | 8/1977 | Germany . | |
| 8906100 | 8/1989 | Germany . | |
| 477511 | 1/1953 | Italy | 417/68 |
| 1208311 | 1/1986 | U.S.S.R. | 417/68 |
| 1460417 | 2/1989 | U.S.S.R. | 417/68 |
| WO92/20925 | 11/1992 | WIPO | 417/68 |

*Primary Examiner*—Richard A. Bertsch
*Assistant Examiner*—Roland G. McAndrews, Jr.
*Attorney, Agent, or Firm*—Kenyon & Kenyon

[57] ABSTRACT

A liquid ring machine having a housing in which there is rotatably arranged a rotor having its axis displaced by an amount of eccentricity with respect to the axis of the housing. The liquid ring machine is capable of optimal use in simple manner for both vacuum and compression operations. This result is obtained by ensuring that amount of eccentricity from the housing axis to the rotor axis is directed to oppose the direction of the force of gravity in vacuum operations and is directed in the direction of the force of gravity in compression operations.

1 Claim, 2 Drawing Sheets

FOOT ARRANGEMENT FOR A LIQUID RING MACHINE

This application is a continuation of application Ser. No. 08/157,593, filed on Nov. 24, 1993, now abandoned.

BACKGROUND OF THE INVENTION

The present invention relates to a liquid ring machine.

In liquid ring machines such as those used as vacuum pumps and as compressors, the axis of the rotor is arranged eccentric to an axis defined by the housing. The two axes are shifted in vertical direction from each other by an amount of eccentricity. Unfortunately, a liquid ring machine which is optimized for vacuum operations does not operate optimally in compressor operation.

From German Patent No. DE-U-89 06 100, a two-stage liquid ring pump having two rotors which act separately from each other is known. Each rotor region forms a pump stage with a separate housing part. The rotors share a common axis which is shifted from the axes of the housing parts by, in each case, an amount of eccentricity. To relieve the bearings and the shaft from transverse forces which occur during operation, the eccentricities of the two pump stages are precisely opposite each other. Unfortunately, such a liquid ring pump requires two separated rotors accommodated in two housings. Further, while the eccentricities oppose each other to relieve transverse forces, the opposing transverse forces do not act at the same axial position of the rotor shaft.

Thus, there exists a need for a liquid ring machine which can be optimally employed, in a simple manner, for both vacuum and compressor operations.

SUMMARY OF THE INVENTION

The present invention fulfills this need by providing a liquid ring machine having a housing defining a housing axis and a rotor having a rotor axis. The rotor axis is displaced by an amount of eccentricity with respect to the housing axis. The amount of eccentricity from the housing axis to the rotor axis is directed to oppose the direction of the force of gravity in a vacuum operation and is directed to lay in the direction of the force of gravity in a compression operation.

In a liquid ring machine according to the present invention, the eccentricity from the axis defined by the housing to the axis of the rotor is directed opposite to the force of gravity for vacuum operations while, for compressor operations, this eccentricity is directed with the force of gravity.

The liquid ring machine of the present invention maximizes efficiency for both vacuum operations (final pressure equal to atmospheric pressure) and compressor operations (suction pressure greater than or equal to atmospheric pressure). The rotor is fitted off-center in the housing. The motion of the rotor causes the working fluid (i.e., the liquid) to form a ring which rotates simultaneously in the housing. The liquid ring recedes from the hub on the intake side due to centrifugal force and the gas is drawn in through the suction port by the vacuum. On the pressure side, the liquid ring again approaches the hub after almost one revolution and expels the compressed gas through the discharge port. Since the variation of the pressure in the gas space influences the contour of the water ring, a liquid ring pump which is optimized for vacuum operation cannot normally operate optimally in compressor operation. Better adaptation to these pressure forces can be obtained by appropriately directing the amount of eccentricity.

In this way, the force ($F_R$)resulting from force of gravity ($F_G$) and hydrodynamic transverse force ($F_H$) is reduced, resulting in greater security of the shaft as well as longer life of the shaft bearings under all operating conditions. In this connection, the efficiency is independent of the place of installation or manner of installation and is independent of the coupling with the drive motor. Thus the liquid ring machine of the present invention can be set up, for instance, in a frame standing on the ground, or fastened, suspended from a wall.

To obtain even better compensation and/or simplified change between vacuum operation and compressor operation, the present invention sets forth various special embodiments. These embodiments by themselves, or in combination with each other, may be advantageous.

With a standing installation of the liquid ring machine, the axis of the rotor and the axis of the housing are offset in vertical direction from each other by an amount of eccentricity. The minimal distance between inner radial surface of the housing and outer radius of the rotor (vertex) is radially above the rotor shaft in vacuum operations and radially below the rotor shaft in compressor operations.

Optimal compensation of the resultant hydrodynamic transverse force by the force of the weight of the shaft is obtained in the case of a liquid ring machine in which the minimal distance between the inside surface of the housing and the outer radius of the rotor is selected such that a hydrodynamic transverse force which acts on the rotor shaft opposes the force of weight of the rotor shaft. As compared with this, rotating the entire liquid ring machine by 180° constitutes a particularly simple means of compensation.

The direction of the eccentricity from the axis of the housing to the axis of the rotor can be changed in particularly simple fashion in a liquid ring machine having at least one of a circumferential fastening ring, a circumferential hose strap, and a clamping strap arranged on the outer circumference of at least one of the housing and the side bracket. If the change of the position of the amount of eccentricity of the liquid ring machine is only turned by 180°, then an embodiment of the liquid ring machine further including standing feet arranged on the housing and additional feet opposite the standing feet and arranged on the housing is particularly advantageous.

DETAILED DESCRIPTION

Figure 1:
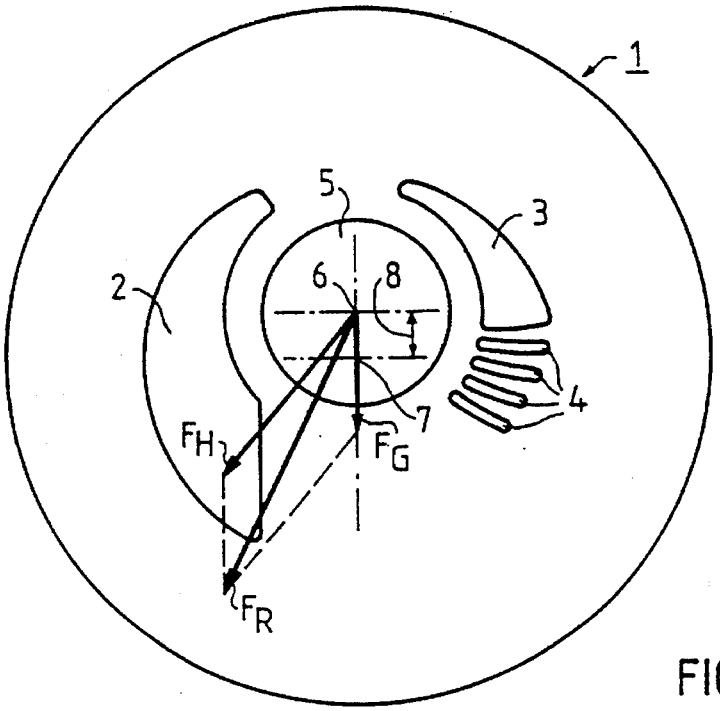
FIG. 1 is a schematic which shows an arrangement of the control disk of the present invention under vacuum operations.
Figure 2:
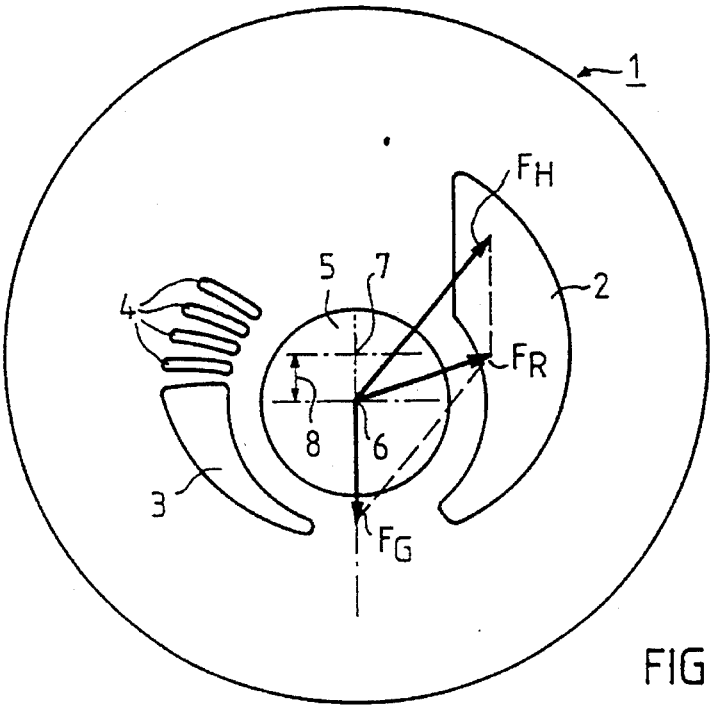
FIG. 2 is a schematic which shows an arrangement of the control disk of the present invention under compression operations.

In FIGS. 1 and 2, 1 is a control disk which is mounted, together with a rotor, in the housing of a liquid ring machine. In the control disk 1 there are present, in known manner, a suction port 2 through which the gas to be compressed enters the cells of the rotor which is in front of the control disk 1 and a delivery port 3 through which the compressed gas emerges. Control ports 4 are formed in the control disk 1 and are associated with the delivery port 3.

A shaft passage 5 is arranged in the control disk 1 of the liquid ring machine of the present invention such that the axis 6 of the rotor is eccentric to the axis 7 of the housing. As shown in FIGS. 1 and 2, the two axes 6 and 7 are spaced vertically from each other by an amount of eccentricity 8.

To compensate for the hydrodynamic transverse force $F_H$ resulting from suction pressure and compression pressure, the amount of eccentricity 8 from the housing axis 7 to the rotor axis 6 in vacuum operation (FIG. 1) is directed opposite the force of gravity and thus opposite to the force of weight $F_G$. In compression operations (FIG. 2), the amount of eccentricity 8 from the housing axis 7 to the rotor axis 6 is directed with the force of gravity. Maximum efficiency is thus obtained in both vacuum operation and compressor operation.

Figure 3:
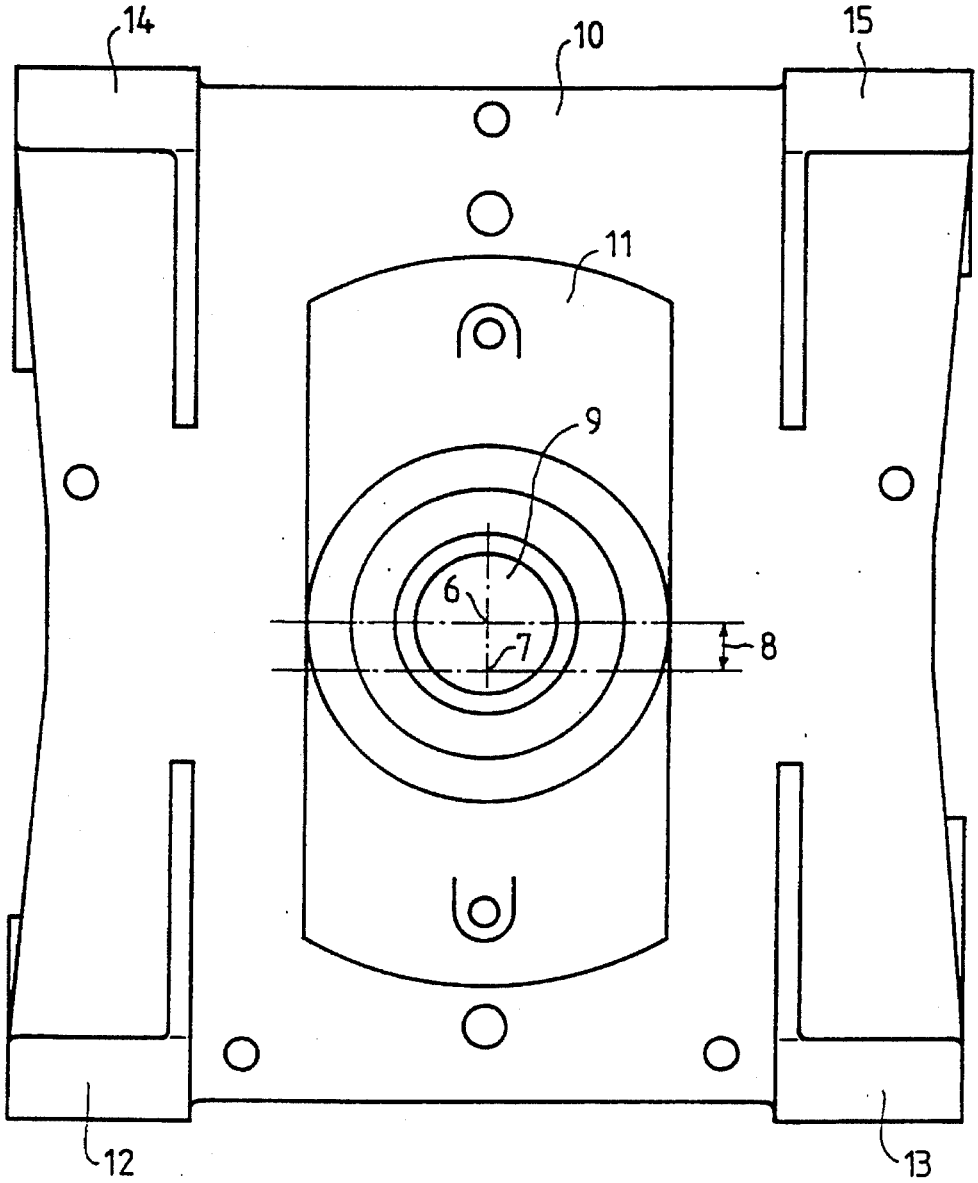
FIG. 3 is an end view of one embodiment of the liquid ring machine of the present invention.

The position of the amount of eccentricity 8 can be changed in particularly simple manner in the embodiment of the present invention shown in end view in FIG. 3. In this embodiment, the shaft 9 of the rotor has its one end mounted in a bearing support 11 cast onto a side bracket 10. The other end of the shaft 9 is also mounted in a bearing support (not shown) which is cast onto the other side bracket (not shown).

The liquid ring machine shown in FIG. 3 is oriented for vacuum operation, as can be noted from the position of the amount of eccentricity 8. A change to compressor operation is effected in the embodiment shown by turning the liquid ring machine 180°. The liquid ring machine then no longer stands, as shown in FIG. 3, on its standing feet 12 and 13, formed on the side bracket 10, but on its additional feet 14 and 15, also developed on the side bracket 10. The additional feet 14 and 15 are preferably identical to the standing feet 12 and 13.

As will be apparent to those skilled in the art, the standing feet 12 and 13 as well as the additional feet 14 and 15 can also be arranged on the housing. Further, instead of standing feet and additional feet, circumferential fastening rings and/or circumferential clamping straps can be provided. In the embodiment employing circumferential fastening rings and/or circumferential clamping straps, the liquid ring pump of the present invention can be rotated such that the hydrodynamic transverse force $F_H$ acting on the shaft 9 of the rotor directly opposes the force of weight $F_G$ of the rotor shaft.

What is claimed is:

1. A liquid ring machine comprising:

a) a housing having a housing axis;

b) a rotor having a rotor axis, the rotor axis being displaced by an amount of eccentricity with respect to the housing axis;

c) a first set of standing feet provided on a first side of the housing; and d) a second set of standing feet provided on a second side of the housing which is circumferentially opposite to the first side of the housing, wherein when the liquid ring machine stands on the first set of standing feet, it operates as a vacuum in which a minimum distance between an inside of the housing and an outer circumference of the rotor determined by the amount of eccentricity is located radially above the rotor shaft in the direction of gravity, and wherein when the liquid ring machine stands on the second set of standing feet, it operates as a compressor in which a minimum distance between an inside of the housing and the outer circumference of the rotor determined by the amount of eccentricity is located radially below the rotor shaft in the direction of gravity.

* * * * *